United States Patent [19]

Meier

[11] Patent Number: 5,004,092

[45] Date of Patent: Apr. 2, 1991

[54] PROCESS AND APPARATUS FOR THE BUFFER STORAGE AND CONVERSION OF FLAT PRODUCTS PREFERABLY OCCURRING IN STREAM FORMATION

[75] Inventor: Jacques Meier, Bäretswil, Sweden

[73] Assignee: Ferag AG, Hinwil, Switzerland

[21] Appl. No.: 288,942

[22] Filed: Dec. 23, 1988

[30] Foreign Application Priority Data

Feb. 17, 1988 [CH] Switzerland ..... 580/88

[51] Int. Cl.[5] ..... B65G 37/00

[52] U.S. Cl. ..... 198/347.3; 271/207

[58] Field of Search ..... 198/347, 374.3; 414/788; 271/207; 53/118, 430; 242/55, 59

[56] References Cited

U.S. PATENT DOCUMENTS

| | | | |
|---|---|---|---|
| 4,072,228 | 2/1978 | Honegger et al. | 198/459 |
| 4,438,618 | 3/1984 | Honegger | 414/788 X |
| 4,509,634 | 4/1985 | Payne | 198/347 |
| 4,509,703 | 4/1985 | Grunder | 198/347 X |
| 4,525,982 | 7/1985 | Meier | 414/788 X |
| 4,569,488 | 2/1986 | Baltisberger | 198/347 X |

FOREIGN PATENT DOCUMENTS

| | | |
|---|---|---|
| 2207556 | 8/1973 | Fed. Rep. of Germany . |
| 2544135 | 4/1977 | Fed. Rep. of Germany . |
| 3304219 | 10/1983 | Fed. Rep. of Germany . |
| 654553 | 2/1986 | Switzerland . |
| 654554 | 2/1986 | Switzerland . |
| 657115 | 8/1986 | Switzerland . |

*Primary Examiner*—Robert P. Olszewski
*Assistant Examiner*—Cheryl Gastineau
*Attorney, Agent, or Firm*—Walter C. Farley

[57] ABSTRACT

A buffer storage arrangement contains at least two roll modules (41–44) with interchangeable roll hubs or rolls. A common feed belt (11), the winding planes of the roll modules (41–44) and a common removal belt (12) are located in a vertical plane. The feed belt (11) passes linearly over the winding stations (41–44) and has a number of branching locations (51–54) corresponding at least to the number of winding stations (41–44). Each winding station (41–44) has a connection to the removal belt (12), which passes linearly beneath the winding stations. In order to be able to select the reciprocal arrangement of the products at the outlet, within the apparatus at least one device (7, 79) is provided for rewinding the rolls or the modifying the inlet parameters of the arrangement of the printed products. This permits unrestricted off-line buffer storage of the products and flexible conversion of their inlet parameters, with respect to their reciprocal positioning, orientation or timing frequency.

10 Claims, 5 Drawing Sheets

PROCESS AND APPARATUS FOR THE BUFFER STORAGE AND CONVERSION OF FLAT PRODUCTS PREFERABLY OCCURRING IN STREAM FORMATION

The invention relates to a process and to an arrangement for the buffer storage and conversion of flat products, particularly printing or printed products, preferably occurring in stream or scale formation.

BACKGROUND OF THE INVENTION

It is known to continuously supply to a roll hub or core flat products of the most varied types and to roll or wind same onto said hub or core (cf. e.g. German patent 2 207 556, Swiss patent application 1 788/86-0). Particularly in printing technology, the printed products are preferably in stream formation and are supplied to the winding station in this way and are wound up to form rolls. If the number of products to be processed in this way is greater than the capacity of a roll, as soon as the latter is full, measures must be taken in order to be able to wind the continuously arriving products onto another empty roll hub. In the simplest, but uneconomic manner, it would e.g. be possible to interrupt the working process and during said interruption to replace the full roll by an empty roll hub.

In addition, Swiss patents 654 553 and 654 554 disclose a process and an apparatus making it possible in the case of only a single winding station with an additional intermediate roll to replace the main roll of the winding station without interrupting the working process. However, the products must be wound in double layer form and for further processing must be subdivided by a special means back into two separate scale or stream flows. If a roll is to be further processed in another working area, such additional means must be provided there for unwinding the double roll. As a function of the intermediate roll capacity and as a result of the double layer form of the wound products on the main roll, in this process it is necessary to replace the roll at relatively short intervals.

DE-OS 33 04 219 discloses an apparatus for stacking printed sheets. The printed sheets supplied by means of a feed conveyor are transferred to a conveyor belt of the apparatus. It is obvious that during this transfer the phase relationship of the printed sheets, i.e. the information concerning the reciprocal overlap or displacement of the printed products, is lost and the sheets are necessarily differently arranged due to the feed taking place at right angles to the conveyor belt. Thus, said apparatus can only be used if there is a subsequent intermediate stacking of the printed products and no significance is attached to the modified phase relationship during further processing. However, in many uses it is desirable or necessary to retain the phase relationship of the printed products throughout all the working stages and also during intermediate storage. Therefore, without additional complicated and expensive measures, said apparatus cannot be used for such purposes. In addition, with said apparatus it is not possible to freely select the reciprocal positioning of the printed sheets on the discharge conveyor. A further disadvantage is that it is not possible, or is only possible with considerable effort and expenditure, to replace the individual rolls or storage rolls because they are juxtaposed in parallel, access to the individual rolls is substantially impossible and consequently the apparatus can only be used to a limited extent as an off-line buffer store.

It is known from DE-OS 25 44 135 to provide two alternately loadable winding stations, in which articles are in each case supplied to one, while the full roll is removed from the other winding station. However, this solution in this form can only be used to a limited extent within an overall process, because the rolls must be supplied to another installation for further processing either manually, or at the best by using handling equipment, i.e. the apparatus constitutes a "dead-end" within a continuous process. Additional stations must be provided for unwinding purposes. Moreover, the right-angled path of the conveyor belts at the transfer locations leads to problems as in the case of DE-OS 33 04 219, because the relative arrangement of the products is necessarily and undesirably modified.

In many applications, e.g. in the printing field, the products for different processing operations occur in a specific arrangement. Thus, newspapers on conveyors are conveyed with the cording first whereas journals and magazines are conveyed with the head or bloom first. Obviously the reciprocal arrangement of the products can vary with regards to a number of other parameters (phase relationship, overshot/undershot conveying, spatial position, etc.). In order to be able to process products with different parameters in a following, standardized process or special machines, it is consequently necessary to convert or standardize these parameters associated with the products. Apparatuses are generally known which, by means of rewinding, convert printed products wound in undershot manner on to a roll and which in the case of mere unwinding would be obtained in overshot manner, into an undershot product flow again. The hitherto known apparatuses of this type have always been specifically intended for given uses and consequently only permit a limited conversion of such parameters. These apparatuses also provide no possibility for the buffer storage of products.

SUMMARY OF THE INVENTION

An object of the present invention is to provide a method and an arrangement which avoid the aforementioned disadvantages and which are usable as both an off-line buffer store and as a functional arrangement for the flexible conversion of parameters of the products within an overall system, while as far as possible achieving limited mechanical overall expenditure, particularly with regards to winding stations.

It is the further object of the invention to provide a method and an arrangement so that, even in the case of very high working capacities, a problem-free replacement of the loaded rolls is possible without interrupting the process and consequently unlimited off-line buffer storage, as well as achieving a flexible relationship with respect to the products supplied to and removed from the apparatus, both with regards to the quantity, the orientation and the reciprocal positioning of the products, while the inventive arrangement is to be positionable in a space-saving manner.

The inventive method permits a continuous supply of random, preferably flexible flat products, which are obtained in stream formation. The method is preferably used in conjunction with printed articles or products. Using a common feed means, a feed belt or conveyor, at least two successively arranged winding stations in the feed direction are loaded. As a function of the quantity of the products supplied and which is dependent on the process speed, two or preferably more winding stations are provided The alternate charging or loading of these winding stations can be controlled in a variable manner. Through a suitable arrangement of a common removal belt or a similar feed means, it is possible to simultaneously load one roll and remove products from the apparatus with another roll, variable control of the relationships between the products supplied and removed being possible. As a result of the free accessibility to the individual roll modules, it is readily possible to bring full rolls from the apparatus into a store, or to supply full rolls from an intermediate store to the apparatus, without influencing or interrupting the working process. By suitable measures, e.g. a rewinding device within the arrangement, it is also possible to modify at random within the arrangement the reciprocal orientation or position of the products at the outlet with respect to those at the inlet or the feed belt. The phase relationship of the products can be kept constant during buffer storage. As a result of this winding method, optimum flexibility of the use possibilities during the winding on and off of the products is ensured and permits a continuous off-line operation within an overall process or system.

The arrangement according to the invention contains at least two roll modules with interchangeable roll cores or rolls. The feed belt, winding planes of the roll or winding modules and the removal belt are preferably located in a vertical plane. The feed belt or a feed conveyor is passed through linearly over the winding stations and has a number of branching locations, points or switches corresponding to the number of winding stations. The individual branches to the winding stations carry the products preferably to the underside of the rolls. Each winding station has a connection to the removal belt, which is passed linearly beneath the winding stations. In order to be able to give the reciprocal arrangement of the products in random manner at the outlet, advantageously within the apparatus is provided at least one device for the rewinding of the rolls or for modifying the intake parameters of the printed product arrangement.

BRIEF DESCRIPTION OF THE DRAWINGS

Embodiments of the invention are described in greater detail hereinafter relative to non-limitative embodiments and with reference to the attached drawings, wherein.

DESCRIPTION OF THE PREFERRED EMBODIMENT

Figure 6:
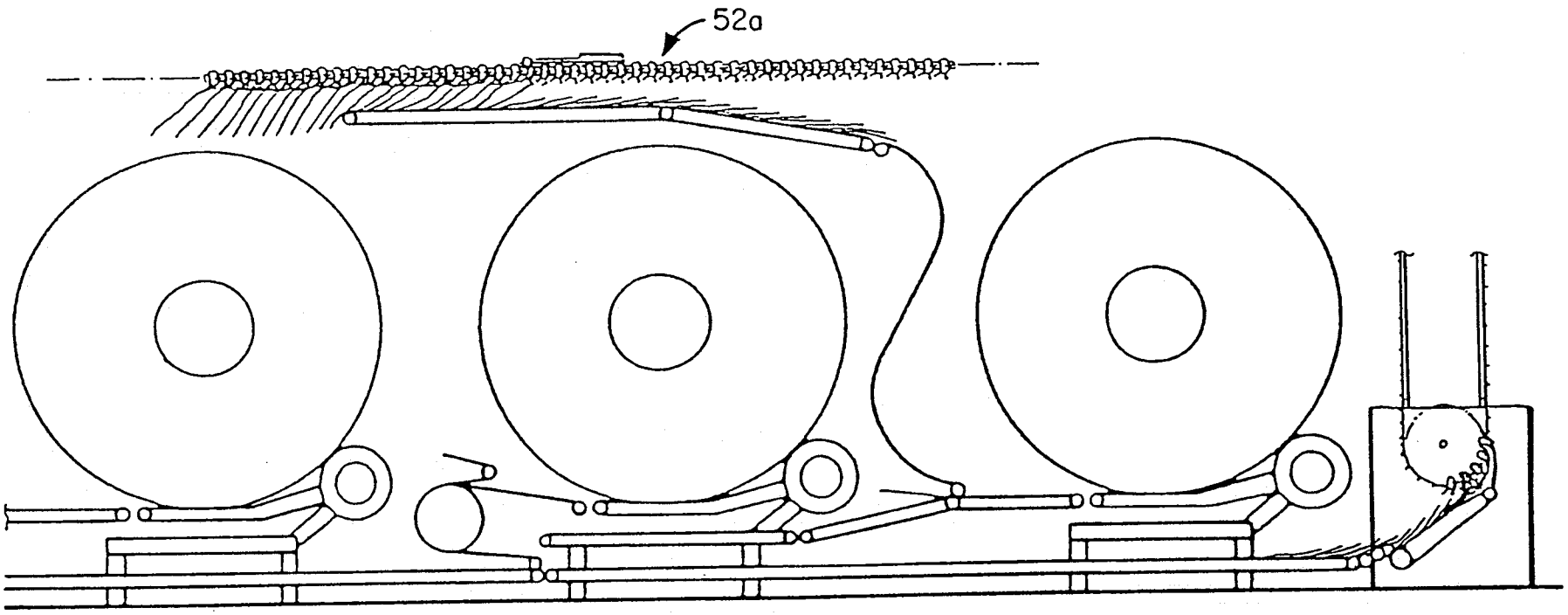
FIG. 6 is a schematic side elevation of a clamp conveyor usable in a system in accordance with the invention.

Although the invention is explained in greater detail hereinafter relative to examples from the field of printing technology, it can obviously also be used in conjunction with various other, flat articles, e.g. flexible plastic parts. It is also not a prerequisite that the products are supplied in a stream formation. Thus, by means of a clamp conveyor such as that shown at **52*a* in FIG. 6**, products held in spaced manner with respect to one another can be wound on and off in the same way.

If printed products obtained with high frequency are to be supplied to another process stage, which has a lower working capacity than would be necessary to be able to receive the continuously produced printed products, or if an interruption occurs during one working stage, then it is necessary to provide a corresponding buffer store. As was explained hereinbefore, known solutions either require considerable mechanical expenditure, or limit the possibilities of the working process. The present invention on the one hand brings about a true off-line buffer storage, i.e. the possible buffer capacity can be as large as necessary. On the other hand the buffer storage arrangement simultaneously provides the possibility of modifying in a flexible manner the different parameters associatable with the printed product supply.

Despite considerable mechanical expenditure, the hitherto known buffer storage means were only capable of fulfilling to one function, namely the storage of the supplied products. The inventive idea is to provide a multi-functional means, which is able to fulfill a number of functions with minimum expenditure. Use is made of the fact that the means necessary for buffer storage, such as e.g. additional winding stations, are present which bring about the mechanical requirements for further functions, particularly the modification of the input or inlet parameters, so that the total mechanical expenditure and effort is optimized in an overall system. Through the use of the apparatus according to the invention at only one point in an overall system, there can be overall optimization of the latter, which is made more flexible. There is no longer any need for reciprocal matching of the working speeds of e.g. the printing press, the inserting and bundling means, etc., because the off-line buffer store forms the necessary interface both with regard to this point as well as other parameters.

Figure 1:
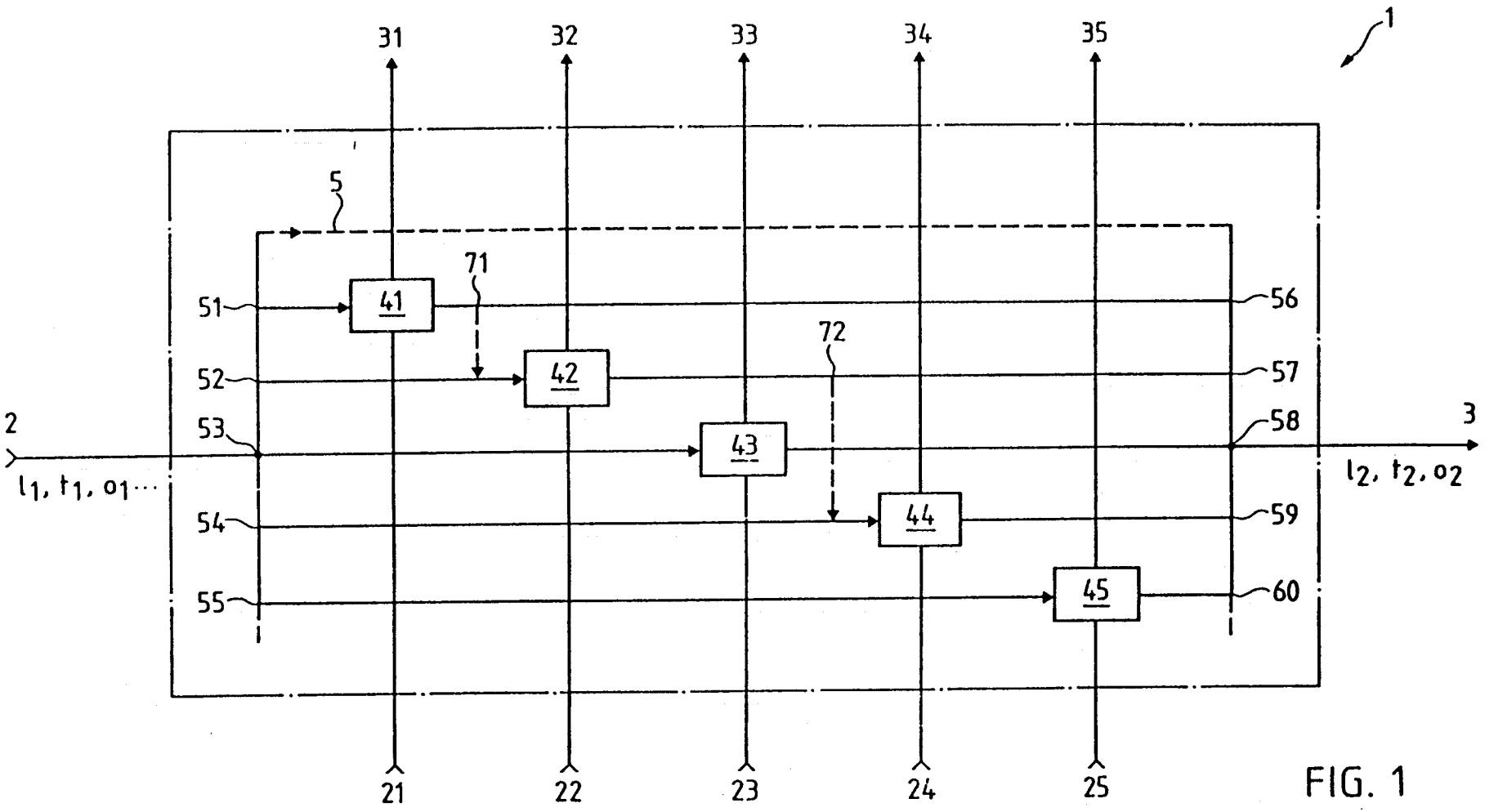
FIG. 1 is a block diagram of the method according to the invention.

The method according to the invention is explained in greater detail hereinafter with reference to the block diagram of FIG. 1. It must be borne in mind that the latter in no way refers to the spatial arrangement of the individual elements and instead only shows the functional connections significant for the present principle. By means of a common inlet 2, the off-line buffer storage means 1, which contains a suitable number of winding or roll modules 41–45, is supplied with printed products at a timing or clock frequency $t_1$, an orientation $o_1$, a phase p and a relative position $I_1$. The phase p or the phase relationship is understood to mean the relative displacement of the printed products in the conveying direction. The orientation o is the spatial position of the printed products (e.g. bloom or cording in the conveying direction, top page at the top or bottom, etc.), while the relative position I indicates whether the printed products are supplied in overshot or undershot manner at inlet 2. At an outlet 3, the printed products are discharged at a clock or timing frequency $t_2$, a phase p, an orientation $O_2$ and a relative position $I_2$. At additional inlets 21–25, whose number is dependent on the number of roll stations in the off-line buffer store 1, empty or loaded rolls with printed products can be supplied to the buffer store 1. The printed products wound on to the roll hubs or cores can in the same way be characterized with parameters $I_{21}$-$I_{25}$,$O_{21}$-$O_{25}$ which describe the "frozen" state of the products, etc. Full, empty or partly wound rolls can be removed from the off-line buffer store at outlets 31–35. Hereinafter, in general terms, inlet parameters are designed $x_i$ and outlet parameters $y_i$.

The rolls supplied or removed via these inlets or outlets are loaded or charged with printed products in such a way that they preferably have the same phase p, but otherwise each roll can contain printed products with its own orientation o and relative position I. At least one of the roll modules 41–45 of the off-line buffer store 1 can modify the position I and orientation o of the printed products supplied to it via one of the inlets 2, 21–25. There can also be a direct connection 5 between inlet 2 and outlet 3. Each roll module 41–45 can contain a main and a buffer winding station or additional means for converting the parameters.

By means of interfaces 51–55, which have the functions of points or switches, inlet 2 is selectively connected to the individual roll modules 41–45 and outlet 3. In a similar way, the outlets of the individual roll modules are connected via interfaces 56–60 to the outlet 3. Obviously inlet 2 can be supplied with products from different installations, i.e. a multiple inlet 2 can be provided. It can also be gathered from FIG. 1 that products can be supplied to the outlet 3 simultaneously and directly from the inlet and/or from one or more roll modules. These products can be spliced together to form unitary stream formations by suitable joining at the interfaces 56–60 or subsequently individual printed sheets or the like can be inserted therein. For this purpose it is possible to use buffer timers according to U.S. Pat. No. 4,072,228, as described in conjunction with FIG. 5.

Printed sheets printed on one side are supplied e.g. in undershot manner and with their printed sides upwards to the inlet 2 at a timing frequency $t_1$. If the printed products are to appear at the outlet with their underside upwards and with a lower timing frequency $t_2$, then the inlet 2 is connected via a switch of switch group 51–55 to the roll module at whose outlet the printed products can be removed with the desired orientation $O_2$. It is clear that in this example the timing frequency can only be modified if part of the printed articles are buffer stored. This is brought about in that e.g. one roll of a first roll module is filled. The inlet 2 is then automatically connected to the second roll module. While the incoming printed products are now stored on the roll in the second roll module, it is possible to remove from the roll of the first roll module printed products with the desired timing frequency $t_2$. The desired timing frequency $t_2$ is attained in that printed products are unwound from the corresponding second roll module at the desired speed and supplied to the outlet 3. It is obviously possible for the roll as a whole to be removed from said roll module via the corresponding outlet.

The following functions or their links or combinations are possible within a roll module:

| | Modification Of: | | |
|---|---|---|---|
| | Reciprocal Position | Orientation | Timing |
| Frequency | | | |
| Type 1 | x | | |
| Type 2 | | x | |
| Type 3 | | | x |
| Type 4 | x | x | |
| Type 5 | x | | x |
| Type 6 | | x | x |
| Type 7 | x | x | x |
| Type 8 | (None of the parameters changed) | | |

Obviously in the case of special process sequences, it may be necessary to modify further parameters and in certain circumstances also the phase p, so that this table only constitutes an example of the functions performable within a roll module. It is obviously possible by the cascade connection of at least two roll modules to interlink the functions, e.g. to obtain a roll module of type 6 by the cascade connection of two modules of types 2 and 3. For this purpose additional points or switches 71, 72 are provided within the buffer store 1, which in the represented arrangement e.g. allow a cascade connection of the roll modules 41, 42 and 44.

As empty and full rolls can be supplied to and removed from the off-line buffer by means of the outlets and inlets 21–25 and 31–35, it is possible to permanently supply thereto via inlet 2 printed products, even in the case of an empty outlet 3, i.e. if no printed products are removed therefrom. Through the intermediate storage of the full rolls from the off-line store 1 in a separate store, it is possible to variably enlarge the storage capacity of the off-line store. As a function of the intended use, the off-line store can contain 2 or preferably more roll modules 41–45. Conversely, from said store, inlets 21–25 can supply the off-line store with full rolls and, by unwinding in a suitable roll module 41–45, products can be discharged at outlet 3 with desired outlet parameters y, without products occurring at inlet 2.

The present invention firstly makes it possible to receive the incoming printed products in the off-line store and, if necessary, to intermediately store the same and the off-line store can also be used as a functional arrangement for converting the parameters $x_i$ associatable with the products. The outlet parameters $y_i$ are in functional dependence on the inlet parameters $x_i$, the possible functions being given on the one hand by the types of the roll modules within the arrangement (cf. the above table) and on the other hand by the reciprocal, additional connections, e.g. 71, 72 in FIG. 1. The buffer storage arrangement can be randomly extended by coordination with an additional, separate store. In the described way, products wound on to a roll can be inserted via inlets 21–25, converted and wound directly within the arrangement on to a new roll (through the corresponding switching of points 71, 72) or can be removed for further processing at outlet 3.

The arrangement is controlled by a computer, which monitors the state of the individual roll modules and is responsible for the functional control of the installation. It is also possible to provide in the vicinity of the conveyor systems sensors for monitoring purposes and which detect any faults or interruptions (e.g. an interruption of the stream). Preferably a central computer monitors and/or controls at least the supply and removal of the products via the inlets and outlets 2, 3, 21–25, 31–35, the winding processes of the individual roll modules 41–45, the position of the points 51–60, 71, 72 and the connections between the roll modules 41–45 and the inlets and outlets 2, 3, 21–25, 31–35 by means of sensors such as optical sensors. It can be necessary in the case of complex roll modules to provide additional decentralized computer units.

Instead of using rolls, the method can also be used in conjunction with other storage means, e.g. pallets or cassettes, the individual roll modules being correspondingly adapted thereto, e.g. the products supplied via inlets 21–25 and discharged at outlet 3.

Figure 2:
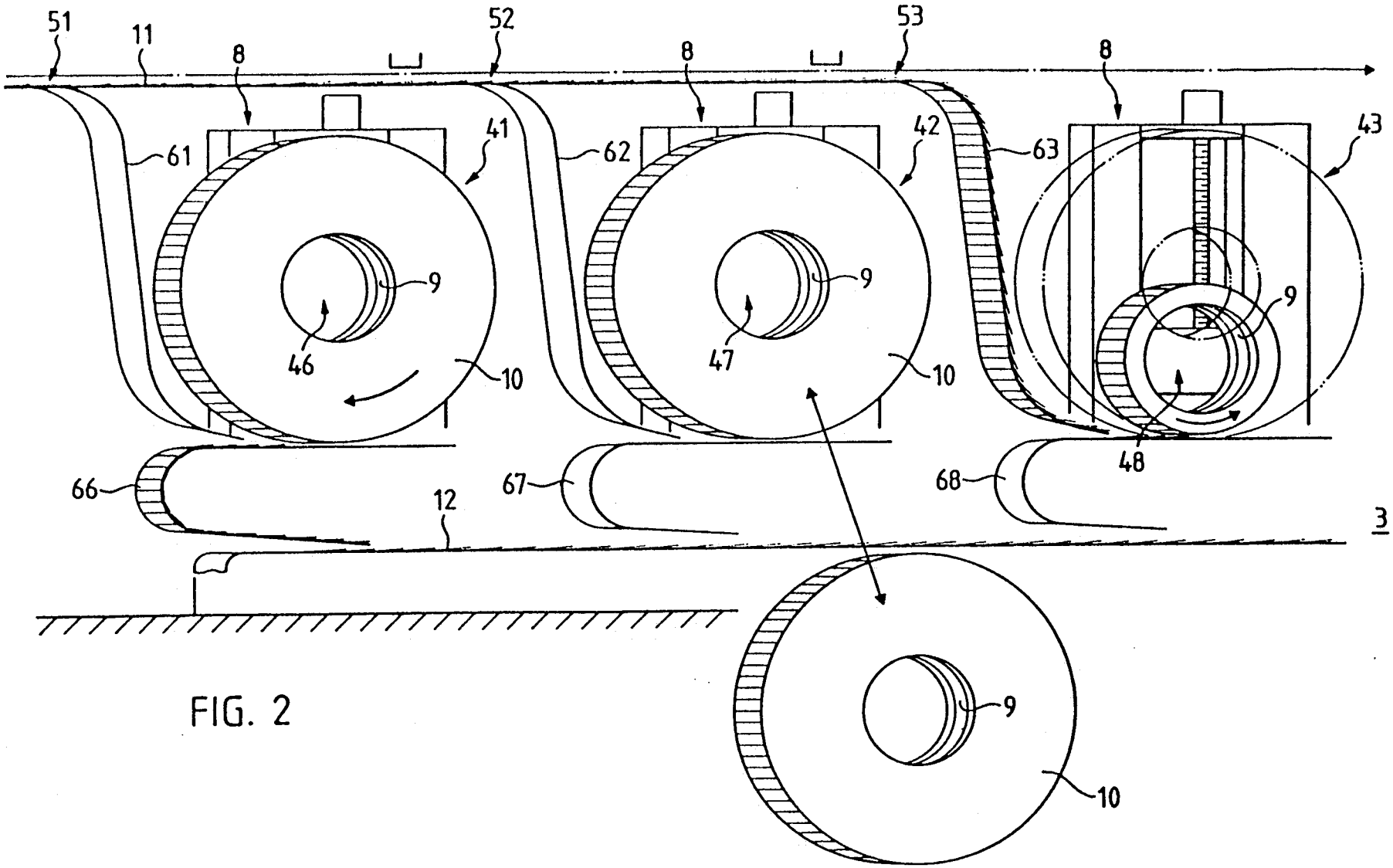
FIG. 2 is an example of a simple arrangement with three roll or winding modules.

Hereinafter is described an example of an arrangement with three winding or roll modules for performing the described method. FIG. 2 shows a common feed belt 11, a common removal belt 12 and three roll modules 41, 42, 43. By means of a first group of points or switches 51,52, 53, in each case one feed connection 61, 62, 63 leads to the corresponding roll modules 41–43 and supplies each roll 10 with the printed products from below. The roll modules contain in each case one winding station 8 with winding mounts 46–48, which serve to wind on or off the rolls 10. The rolls 10 have a core or hub 9, which makes it possible to replace the rolls in the winding stations A possible construction of the winding stations, the winding on and off and the way in which the rolls or roll cores are replaced can be gathered from Swiss patent applications 00 860/87-5 (the U.S. counterpart of which is U.S. Pat. No. 4,898,336), 1 788/86-0 (U.S. Pat. No. 4,768,768) and 2 267/84-6 (U.S. Pat. Nos. 4,593,865; 4,601,436; 4,641,795; and 4,682,741). The roll modules are successively arranged in the feed direction in such a way that the winding planes, i.e. the center planes of the rolls at right angles to the winding axis of the individual winding stations 8, are vertical and in one plane. The feed belt passes linearly over the roll modules 41–43. In a similar manner the removal belt 12 is located below the roll modules, parallel to the feed belt and the roll planes. It is possible to interchange the arrangement of the feed and removal belts, or to have a slight lateral displacement with respect to the roll modules. It is also possible for the individual winding stations to be laterally displaced for special uses, the feed and removal means having corresponding points or connecting paths for overcoming the lateral displacement.

It is readily apparent that instead of having belts as the feed or removal means, the apparatus can have feed and removal means of other types, e.g. a clamp conveyor, a belt conveyor, or a clamp chain system. Different feed means can be used for the connecting sections between the points 51, 52, 53 to the individual roll modules 41, 42, 43.

Thus, all the feed paths and roll modules are arranged parallel to a vertical plane. This arrangement of the roll modules or the conveyor belts has the important advantage that all the winding stations 41–43 or the rolls held on their roll mounts 46–48 can readily be reached from at least one side, so that the rolls or roll hubs can be moved backwards and forwards, gripped and interchanged by means of an industrial truck, which moves along the arrangement in a path parallel to said plane. This simple handling possibility makes it possible to use special, e.g. also inductively controlled handling means. Due to the interchangeability of the rolls, a randomly large number of printed products can be stored in space-saving and inexpensive manner in a separate store. As in the case of high working capacities, very frequent replacement of the rolls is necessary, there are thus generally at least three roll modules. As can be gathered from the drawings, in this embodiment coincidence exists between the inlets 21–25 and the outlets 31–35, i.e. the rolls are inserted and removed at the same point of the roll modules.

A second feed connection 66, 67, 68 with a 180° deflection leads from each roll module to the common removal belt 12. As is readily visible, the products supplied by the feed belt 11 are reversed by winding on and off in a roll module, i.e. their orientation o is changed. In this embodiment all the roll modules 41–43 are the same and correspond to the aforementioned type 2. If the unwinding speed of the individual roll modules is controllable, it is also possible to achieve a desired timing frequency at outlet 3, in the case of a corresponding speed of the removal belt 12.

Figure 3:
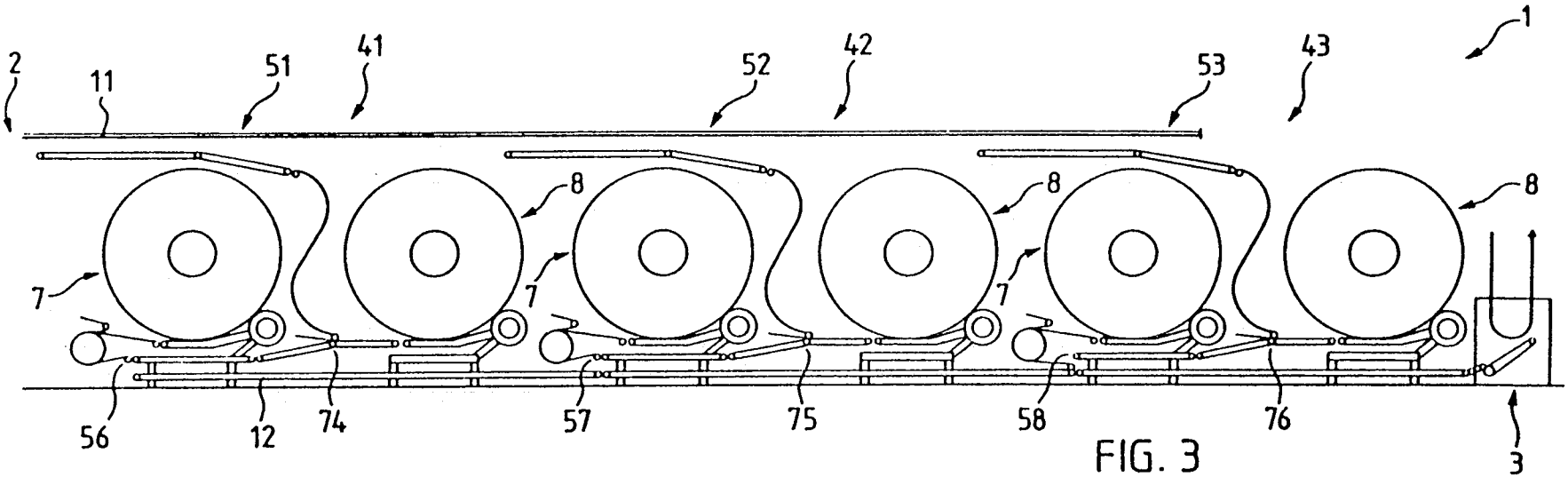
FIG. 3 is an arrangement with three roll modules with in each case a rewinding device.

FIG. 3 shows another embodiment of the invention. Once again there is a common feed belt 11, a common removal belt 12, switch points 51–53 and three roll modules 41–43. In this case, each roll module contains a winding station 8 and a rewinding device 7. The manner of the rewinding is e.g. described in U.S. Ser. No. 497,142, filed May 23, 1983. Points 74–76 on the one hand connect the main roll 8 to the feed belt 11 and on the other hand to the rewinding device 7. Through a second group of switch points 56–58, the rewound printed products can be brought from a rewinding device to the removal belt 12. As is readily apparent, between the inlet 2 and the outlet 3, the printed products retain their orientation and their reciprocal positioning. Thus, referring to the above table, it is a roll module of type 3 or 8.

In order to be able to achieve a modification to the orientation of the printed products with said roll modules, it is e.g. possible to provide additional points at the winding station 8, which connects the latter directly to the removal belt 12 or, by means of points, there can be a direct connection from the feed belt 11 to the individual rewinding devices 7.

Figure 4:
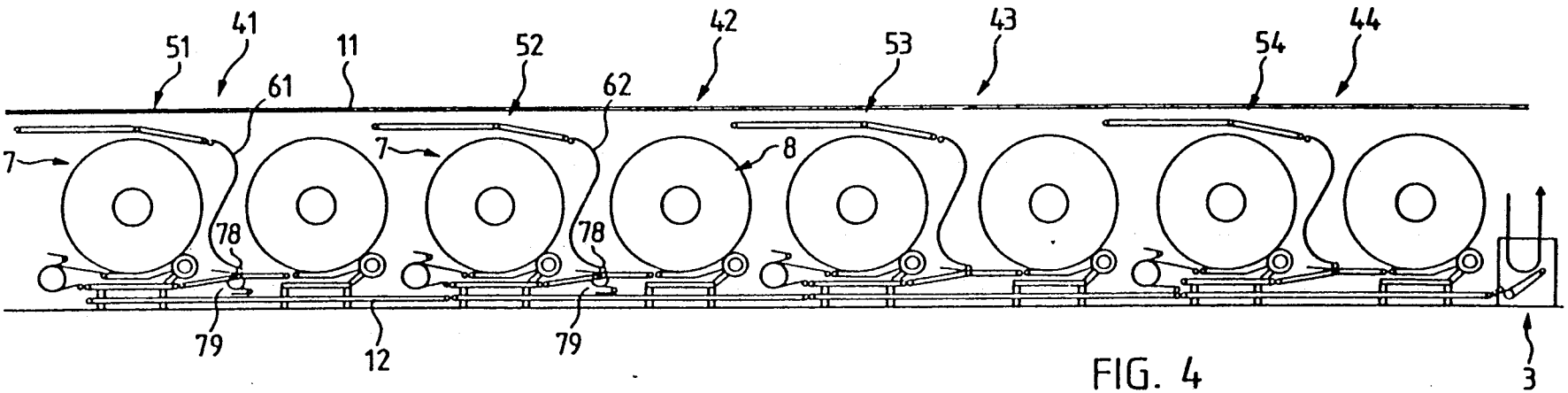
FIG. 4 is another arrangement with two roll modules with in each case one winding device, as well as two roll modules with the possibility of rewinding or a 180° deflection of the printed products.

FIG. 4 shows an arrangement with two winding modules 41, 42 of type 2 or 6 and two winding modules 43, 44 of type 8. In addition to the rewinding device 7, winding modules 41, 42 have a rewinding device 79, which reverses the printed products by 180°, i.e. modifies their orientation o. By means of an associated point 78, either the rewinding device 7, or the rewinding device 79 of said winding stations can be activated. Thus, the printed products supplied via feed connections 61, 62, as a function of the position of points 78, are supplied to the removal belt 12 in unchanged manner, or turned by 180°. If the products are to be supplied to outlet 3 in unchanged form, then they can be stored by any one of the roll modules 41–44 by setting the points 51–54. However, if the orientation of the printed products is to be changed, i.e. parameter o is converted, then preferably use is made of roll modules 41 and 42. It is naturally also possible to carry out buffer storage by means of the roll modules 43, 44 and to carry out conversion in a second operation by means of module 41 or 42.

In order to be able to control the rotation speed of the rolls during unwinding (modification of the timing frequency $t_1$ to $t_2$), the drive must be speed-variable and use can be made of a reversible two-speed asynchronous motor.

The points 51–60, 71, 72, 79 etc. are adequately known from the prior art and can e.g. be in the form of short, pivotable conveyor belt sections.

Figure 5:
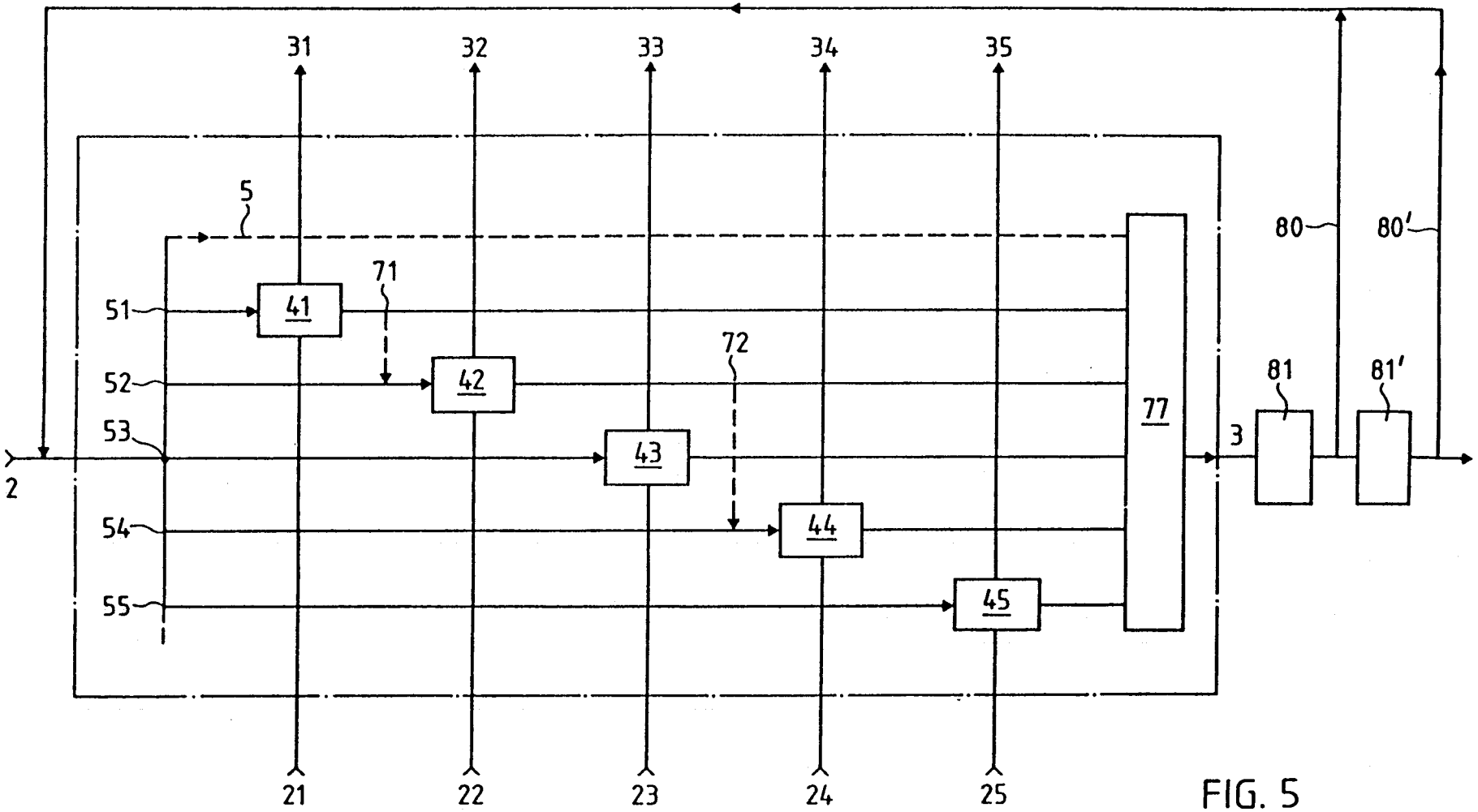
FIG. 5 is a block diagram of the method according to the invention with two return means and a buffer timer.

FIG. 5 shows another possible use of the method according to the invention. The basic diagram and the reference numerals correspond to FIG. 1. In the vicinity of outlet 3 is provided a buffer storage timer 77, such as is e.g. known from U.S. Pat. No. 4,072,229. This makes it possible to simultaneously remove products by means of connection 5 and/or from different roll modules 41–45. By means of the timer 77 the corresponding product flows are "spliced together", i.e. joined to form a single stream and supplied to the outlet 3. In addition, there is at least one return mechanism 80 from outlet 3 to inlet 2. As stated, said return mechanism 80 can be provided after a first machine module 81, which represents one processing step for the products. It is also possible to provide a return mechanism 80' to inlet 2 after each further machine module. Thus, in the case of a failure of any machine module, the products can be returned to inlet 2 and consequently it is only necessary to provide a single buffer storage means 1 within an overall system. An apparatus for performing this method can be achieved in simple manner in that the return mechanisms, in much the same way as the feed paths 61–63 in FIG. 2, are returned to the feed belt from above.

What is claimed is:

1. An apparatus for the buffer storage of flat articles such as printed products occurring in the form of stream formations, comprising the combination of a main inlet location and a main outlet location;

buffer storage means having at least two roll modules, said roll modules (41–45) being successively arranged with respect to a feed direction and each said roll module having a roll mount (46–50) and a roll with a winding plane oriented substantially parallel to a vertical plane, each said roll mount being freely accessible from at least one side;

a first and second group of switch points (51–55, 56–60) interconnecting said buffer storage means with said main inlet and outlet; and common feed means (11) and common removal means (12) operatively associated with each of said roll modules, said feed and removal means being substantially parallel to said winding plane.

2. An apparatus according to claim 1 wherein said feed and removal means comprise conveyor belts, the feed belt (11) being located above the roll modules (41–45) and the removal belt (12) being located below the roll modules.

3. An apparatus according to claim 1 wherein each said feed means and removal means comprises a clamp conveyor.

4. An apparatus according to claim 1 wherein said feed and removal means (11, 12) and the winding planes of said roll modules (41–45) are located in a common, vertical plane.

5. An apparatus according to claim 4 wherein at least one roll module (41–45) comprises a rewinding device (7).

6. An apparatus according to claim 4 wherein at least one roll module (41–45) comprises a deflecting device (79).

7. An apparatus according to claim 1 wherein said feed and removal means (2, 3) are linked by a direct feed section (5).

8. An apparatus according to claim 1 wherein said second group of points (56–60) comprises a buffer storage timer (77).

9. An apparatus according to claim 8 wherein at least two roll modules (41–46) are directly interconnected by means of switching points (71, 72).

10. An apparatus according to claim 9 and comprising a reversible two-speed asynchronous motor drive for said roll modules (41–45).

* * * * *

UNITED STATES PATENT AND TRADEMARK OFFICE

CERTIFICATE OF CORRECTION

PATENT NO. : 5,004,092

DATED : April 2, 1991

INVENTOR(S) : Jacques Meier

It is certified that error appears in the above-identified patent and that said Letters Patent is hereby corrected as shown below:

On the Title page, item [75], after the inventor's name, the residence should read "Bäretswil, Switzerland".

Signed and Sealed this

Eighth Day of June, 1993

*Attest:*

*Attesting Officer*

Michael K. Kirk

MICHAEL K. KIRK

*Acting Commissioner of Patents and Trademarks*